United States Patent [19]

Yamasaki

[11] Patent Number: 4,699,422

[45] Date of Patent: Oct. 13, 1987

[54] RECLINING AND SWINGABLE CHAIR

[75] Inventor: Yoshikiyo Yamasaki, Osaka, Japan

[73] Assignee: Kabushiki Kaisha Fuji Iryoki, Osaka, Japan

[21] Appl. No.: 892,674

[22] Filed: Aug. 1, 1986

[51] Int. Cl.[4] ..... A47C 4/44

[52] U.S. Cl. ..... 297/18; 297/25; 297/316; 297/345

[58] Field of Search ..... 297/18, 25, 218, 316, 297/320, 433, 345

[56] References Cited

U.S. PATENT DOCUMENTS

| | | | |
|---|---|---|---|
| 1,975,689 | 10/1934 | Hall | 297/18 |
| 2,887,149 | 5/1959 | Cassin | 297/35 |
| 3,154,344 | 10/1964 | Stableford | 297/18 |
| 3,589,715 | 6/1971 | Mark | 297/316 X |
| 4,597,604 | 7/1986 | Siuger | 297/18 |

FOREIGN PATENT DOCUMENTS

| | | | |
|---|---|---|---|
| 1208175 | 5/1901 | Fed. Rep. of Germany | 297/18 |

*Primary Examiner*—Kenneth J. Dorner
*Assistant Examiner*—Peter R. Brown
*Attorney, Agent, or Firm*—Flynn, Thiel, Boutell & Tanis

[57] ABSTRACT

A reclining and swingable chair comprising a front leg having a first U-shaped member; a rising rod provided at the upper portion of the first U-shaped member; a first reinforcing member provided at lower end of the rising rod; a supporting rod provided at the front lower end of the first U-shaped member and projected forwardly and upwardly; a pair of connecting rods respectively provided at the rear lower end of the first U-shaped member; a rear leg having a second U-shaped member; a second reinforcing member provided at the upper portion of the second U-shaped member; a holder provided at the lower end of the second U-shaped member for holding the connecting rod for thereby allowing the front and rear legs to be crossed with each other; and a seat cloth stretched between the first and second reinforcing rods. The reclining and swingable chair further includes a back support rod pivotally supported on the rising rods and a leg supporter connected with front tip ends of the rear leg via a ratchet. With such as arrangement, the reclining and swingable chair is usable as a swingable chair, a legless chair or an exercise chair.

6 Claims, 6 Drawing Figures

RECLINING AND SWINGABLE CHAIR

BACKGROUND OF THE INVENTION

1. FIELD OF THE INVENTION

The present invention relates to a reclining and swingable chair, more particularly, to a reclining and swingable chair having a seat portion and a back portion which rock with respect to each other for enabling a user to stretch and bend his spinal column by moving his weight, with the chair also being usable as an ordinaly chair or a legless chair.

2. DESCRIPTION OF PRIOR ART

Recently, there is a striking tendency for the spinal column to be bent because of improper walking and sitting postures of children and adults. An apparatus to rectify such posture or stretch and bend the spinal column is now popular.

The apparatus as mentioned above, called an exercise unit, has shortcomings in that it needs a wide space to accomodate it and much time and labor for fabrication and operation thereof. Inasmuch as these units aim to keep one healthy, they do not have any other practical uses.

The chair used in general is manufactured only for use in sitting thereon. With such an arrangement of chair, there is sometimes created pain to those who sit on the chair for a long period of time since the chair allows the spinal column to be crooked due to a load applied to the spinal column.

Among known chairs, there are such chairs wherein the load applied to the column is reduced, such chairs resembling a rocking chair or the like. Such chairs are widely used and are structured in such manner that a portion thereof that contacts the floor is curvely formed so that the chair is easily swingable as a whole, and a back reclining portion is covered with a cloth to gently support the back, or a contacting portion with the back is gently curved as a whole. However, such chairs as a rocking chair aim to only support the back gently for thereby allowing the user to sit thereon to reduce the load applied to the back but do not aim to be widely used as an exercise chair to stretch the back of the user while also being used an ordinaly chair.

SUMMARY OF THE INVENTION

It is an object of the present invention to provide a reclining and swingable chair improving on the function thereof and having multiple functions.

Another object of the present invention is to provide a reclining and swingable chair to be used as an ordinary chair.

Still another object of the present invention is to provide a reclining and swingable chair to be used as a legless chair.

Still a further object of the present invention is to provide a reclining and swingable chair to be used as a exercise chair to stretch and bend the back of a user by movement of the weight of the user.

The reclining chair according to the present invention has a front leg pivotally crossed with a rear leg, a seat portion is provided between the front leg and the rear leg, and a connecting rod is provided under the crossing point of the front leg and the rear leg. The front leg has a rising rod at the upper portion thereof, a supporting rod at the front lower end thereof, and a connecting rod at the rear lower end thereof. A first reinforcing member is provided at the lower end of the rising member. The rear leg has a second reinforcing member provided at the upper portion thereof, and a holder at the lower portion thereof to hold the connecting rod. A seat cloth is stretched between the first and second reinforcing members.

DETAILED DESCRIPTION

Figure 1:
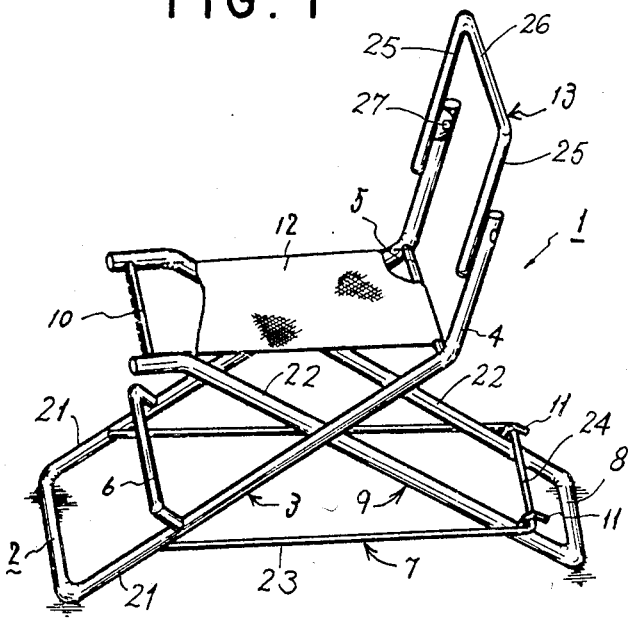
FIG. 1 is a perspective view of a reclining and swingable chair according to a first embodiment of the present invention.

Designated at 1 is a reclining and swingable chair according to the present invention. The reclining and swingable chair 1 comprises a front leg structure and a rear leg structure which are crossed relative to each other. The front leg structure comprises a first U-shaped member 3 having parallel front legs 21 which, at their front ends, are joined by a transversely extending bar 2 which supportingly engages the floor or ground. These legs 21, at their rear ends, are joined together by a transverse reinforcing member 5. The rear ends of legs 21 also rigidly join to two rod portions 4 which project upwardly from the legs 21 at an angle thereto so that the rod portions 4 project approximately vertically when the chair is in the positions illustrated by FIGS. 1-3.

The front leg structure 3 also has a supporting rod 6 rigidly joined to and extending transversely between the legs 21 at a location where it is spaced rearwardly from the transverse floor-engaging bar 2.

The rear leg structure comprises a second U-shaped member 9 having parallel rear legs 22 which are disposed respectively adjacent the legs 21. The rear legs 22 at their rearward ends are joined by a transversely extending bar 8 which supportingly engages the floor or ground. Legs 22 at their forward ends are joined together by a second transverse reinforcing member 10 which extends parallel with the first reinforcing member 5.

A U-shaped connecting member or rod 7 cooperates between the front and rear leg structures to hold them in an open X-shaped configuration as shown by FIG. 1. This connecting member 7 has parallel side legs 23 which adjacent their front free ends are pivotally joined to the respectively adjacent front legs 21, such as in the vicinity of the support rod 6. These side legs 23 project rearwardly so as to straddle the rear legs 22, and the side legs 23 are joined together at their rearward ends by a transversely extending bight or bar 24, the latter being disposed on the rearward or upper side of the rear legs 22. This transverse bar 24 is adapted for engagement within hooklike holders 11 which are fixed to the rear legs 22 adjacent the rearward ends thereof. These holders 11 project upwardly and rearwardly away from the legs 22 to define a generally reversed L-shaped configuration to hold the connecting member 7 in engagement with the rear legs 22. A seat cloth 12 is stretched between the first and second reinforcing members 5 and 10.

Figure 6:
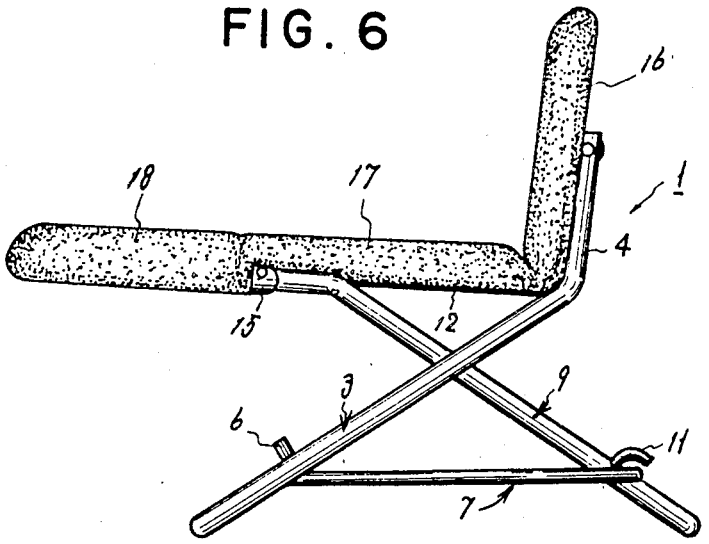
FIG. 6 is a side elevational view showing the reclining and swingable chair of FIG. 2 in a different position.

The supporting rod 6 provided on the front leg structure is formed by bending a pipe etc. having a relatively small diameter, to form a shallow U-shaped configuration, the latter being disposed so that the short legs at their free ends are welded to the front sides of the front legs 21 at a location spaced slightly rearwardly from the base leg or bar 2. This shallow U-shaped support rod 6 is oriented so that it projects substantially transversely forwardly or upwardly from the plane of the U-shaped member 3, whereby the transverse bight of the U-shaped rod 6 is hence spaced upwardly a small distance from the plane of the U-shaped member 3. The bight or transverse bar of this rod 6 hence functions as a stop adapted to support thereon and be engaged by the second reinforcing member 10 when the reclining and swingale chair is used as a legless chair as shown in FIG. 6.

Any shape of the holder 11 capable of engaging and holding the bar 24 is sufficient, and is not limited to a reversed L shape.

Figure 3:
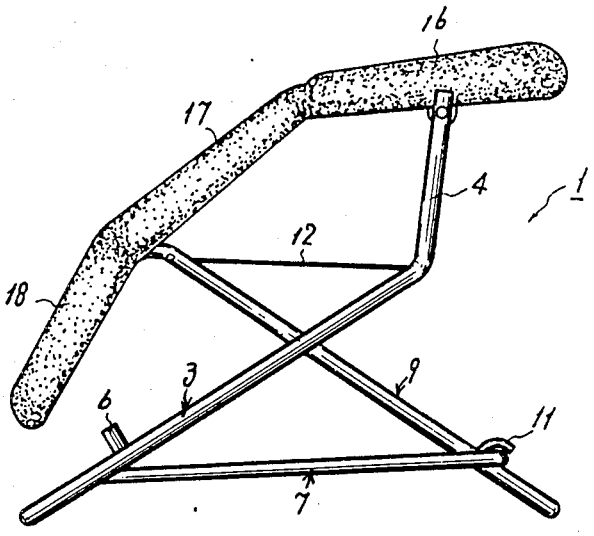
FIG. 3 is a side elevational view showing a reclining and swingable chair to be used as an exercise chair according to the present invention.

Designated at 13 in the figures is a back supporting rod rotatably horizontally pivotally mounted adjacent the upper ends of the rising portions 4. More in detail, the back supporting rod 13 is of a reversed U shape having a pair of generally parallel side legs 25 joined together by the transverse bight or bar 26 joined to the upper ends of the side legs 25. These side legs 25 are respectively disposed adjacent the rods 4 and, at a location spaced from the ends thereof, are pivotally joined to the rods 4 to define a horizontal pivot axis 27. The top bar 26 is spaced upwardly a substantial distance from this pivot axis 27. In normal usage as the chair, the U-shaped support rod 13 is oriented generally vertically parallel with the plane defined by the parallel upright rods 4 substantially as shown by FIG. 1. With this arrangement, however, if the back of the user is reclined to engage the back supporting rod 13, the back supporting rod 13 is freely rotatable about the pivotal point 27 as a fulcrum for thereby enabling the user to sit quickly and relaxedly on the reclining and swingable chair 1. In fact, the supporting rod 13 can pivot about the axis 27 so that the plane of rod 13 extends transverse with respect to the rods 4, as illustrated by FIG. 3.

Designated at 14 is a U-shaped leg supporter connected to the free front ends of the legs 22 of the rear second U-shaped member 9 via a ratchet 15 for enabling the legs of the user to be supported at a desired angle which the user requires.

Designated at 16 is a back mat part covering the whole of the back supporting rod 13, 17 is a seat mat part mounted on the seat cloth 12, and 18 is a leg mat part covering the whole of the leg supporting rod 14. These mat parts are joined together to define a cushion for the chair and are made of elastic materials such as urethane, polyester or the like for allowing the impact load applied to the back to be absorbed and to improve the sitting condition of the user.

Figure 2:
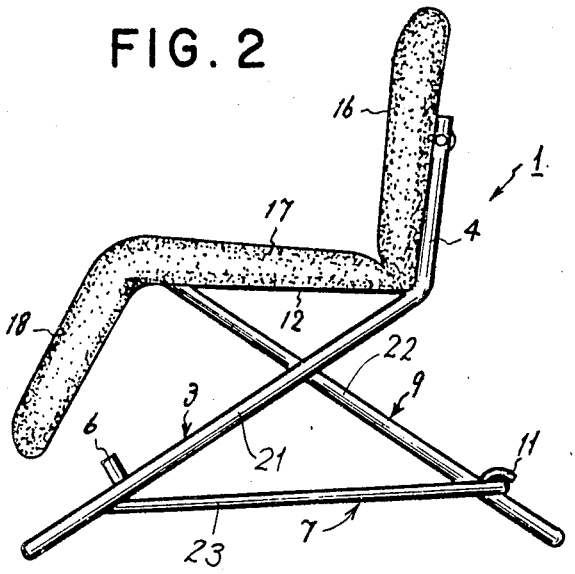
FIG. 2 is a side elevational view of a reclining and swingable chair to be used as a swingable chair according to an embodiment of the present invention.

With the reclining and swingable chair according to the present invention, the operation thereof will be described with reference to the drawings. When the chair is used as a swingable chair, the connecting rod 7 is held by the holders 11 as shown in FIGS. 1 and 2 to rigidly hold the front leg 3 and the rear leg 9 in an X shape. The chair in such configuration is also usable as a swingable chair capable of stretching the back of the user by sitting on the seat portion and pivoting the back supporting rod 13 rearwardly as shown in FIG. 3.

Figure 4:
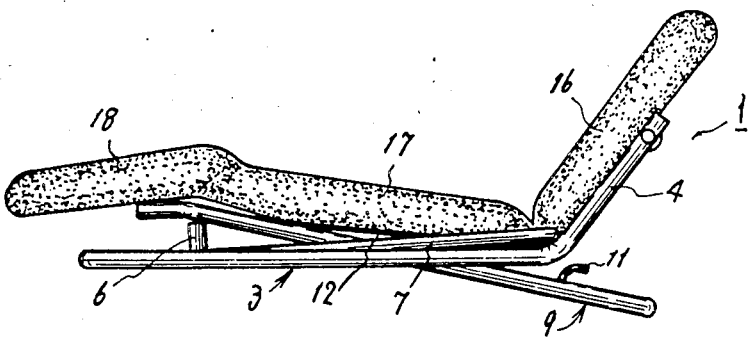
FIG. 4 is a side elevational view of a reclining and swingable chair configured to be used as a legless chair.
Figure 5:
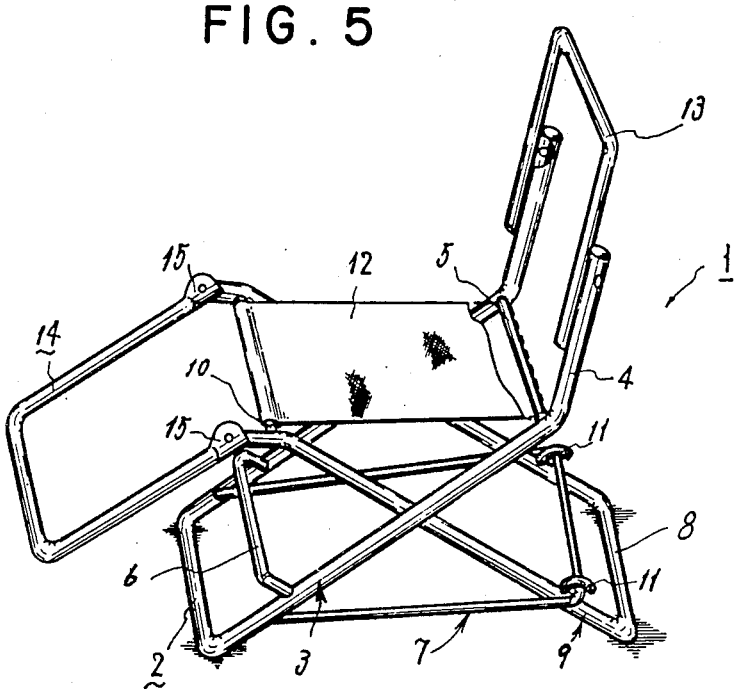
FIG. 5 is a perspective view of a reclining and swingable chair with a leg support thereon.

When the chair is used as a legless chair, the connecting rod 7 is released from the holders 11, and the front leg 3 and the rear leg 9 are folded (i.e. collapsed downwardly on each other to enable the front ends of the rear leg structure to be supported by the supporting rod 6 as shown in FIG. 4, thereby allowing the reclining and swingable chair to be used as an ordinary legless chair and to be also used as an exercise legless chair capable of stretching the back of the user with the back supporting rod 13 being rearwardly pivoted similar to FIG. 3.

Further, with the leg supporter 14 connected with the rear leg 9 via the ratchet 15, the user can quickly sit on the chair in a relaxed state by adjusting the leg supporter 14 to a desired angle.

As mentioned above, the reclining and swingable chair according to the present invention has the front and rear legs crossed with each other, the seat portion provided between the front and rear legs at a position slightly over the crossing portions, and the connecting rod provided at a position slightly under the crossed portions. The front and rear legs are connected only by the connecting rod to thereby selectively permit use as a swinging chair, or a legless chair with a simple operation, and also permitting use as an exercise chair capable of stretching the back of the user.

The reclining and swingable chair with such an arrangement has an advantage to meet the requirements desired from a structural and functional point of view.

Although certain preferred embodiments have been shown and described it should be understood that many changes and modifications may be made therein without departing from the scope of the appended claims.

What is claimed is:

1. In a chair which can be selectively configured in either a first configuration so as to function as a legged chair or a second configuration so as to function substantially as a legless chair, said chair having a seat part which is disposed in a raised position at an elevation substantially above a supporting surface when in said first configuration and is disposed in a lowered position at an elevation closely adjacent the supporting surface when in said second configuration, said chair comprising:

first and second leg structures which in side elevation create an X-shaped frame for supporting the seat part when the chair is in said first configuration;

said first leg structure including a pair of first elongated leg members which are in generally parallel and sidewardly spaced relationship with respect to one another, said first leg members at their lower front ends being adapted for supporting engagement with said supporting surface, said first leg members having generally straight elongated leg portions which are sloped upwardly as they project rearwardly away from said front ends, said first leg members also including rear riser portions which project generally upwardly from and are fixedly joined to the rearward ends of said leg portions when the chair is in said first configuration;

said first leg structure including a first support bar extending transversely between and connected to said pair of first leg members substantially in the vicinity of the intersection between said rear riser portions and the respective leg portions;

said second leg structure including a pair of second elongated leg members which are in generally parallel and sidewardly spaced relationship, said second leg members at their lower rearward ends being adapted to supportingly engage the supporting surface, said second leg members being sloped upwardly as they project forwardly when the chair is in said first configuration;

said second leg structure including a second support bar extending transversely between and connected to said second leg members adjacent the forward ends thereof, said second support bar extending generally parallel with said first support bar;

said seat part being connected to and extending between said first and second support bars for defining an upwardlyfacing seating surface adapted for supporting a user;

a back support structure mounted on and extending transversely between said upper riser portions;

a connecting structure releasably connectingly coupling said first and second leg structures together in a front-to-back direction for holding said chair in said first configuration and being releasable to permit vertical collapsing of said X-shaped frame so that the chair can be disposed in said second configuration, said connecting structure including a pair of elongated connecting elements which have one end thereof connected to a respective one of said first and second leg members adjacent the lower end thereof, and said elongated connecting elements having the other ends thereof respectively releasably engaged with a holding structure associated with a respective other of said first and second leg members, said holding structure being disposed in the vicinity of a lower end of its respective leg member; and a supporting member fixed to and extending transversely between said first leg members in the vicinity of but spaced slightly rearwardly from the lower front ends thereof, said supporting member projecting upwardly from a plane which passes through the longitudinally extending center lines of said elongated leg portions of said first leg members, said supporting member being disposed under and in direct supporting engagement with said second leg structure when said chair is in said second configuration.

2. A chair according to claim 1, wherein said back support structure is pivotally connected to said rear riser portions adjacent the upper ends thereof about a substantially horizontally-extending pivot axis to permit tilting of the back support structure.

3. A chair according to claim 2, including a leg supporter connected to the front ends of said second leg members by means of an angularly adjustable ratchet so that the leg supporter projects forwardly from the seat part and can be selectively angularly adjusted.

4. A chair according to claim 3, including an elongated mat-like cushion of an elastomeric material having an upper end part mounted on said back support structure, a lower end part mounted on said leg supporter, and an intermediate part which is joined between said upper and lower end parts and is adapted to overlie said seat part, said intermediate mat part being free of direct connection to said seat part so as to be movable vertically away therefrom when the chair is used for exercising due to pivoting of the back support structure about its pivot axis when the user shifts his weight.

5. A chair according to claim 2, wherein:

said first leg structure comprises a first U-shaped element having parallel side parts joined together by a perpendicularly extending bight part, the parallel side parts defining said first leg members, and said bight part being fixedly transversely joined between the lower ends of said first leg members and being adapted to engage the supporting surface;

said second leg structure comprising a second U-shaped element having spaced parallel side parts defining said second leg members and having a bight part which extends perpendicularly between and is fixedly joined to said second leg members adjacent the lower rear ends thereof, said second bight part being disposed for engagement with said supporting surface;

said back support structure including a third U-shaped element which opens generally downwardly and includes vertically elongated and generally parallel side parts which at a location disposed intermediate the ends thereof are pivotally joined to said rear riser portions so as to define said horizontal pivot axis, said third U-shaped element having a bight part which extends perpendicularly between and is rigidly joined to said last-mentioned side part adjacent the upper ends thereof whereby said last-mentioned bight part extends generally parallel with but is transversely spaced a substantial distance from said pivot axis;

said connecting structure including a fourth U-shaped element having elongated and generally parallel leg parts which define said pair of connecting elements and adjacent their free ends are connected to said first leg members adjacent the lower ends thereof, said fourth U-shaped element including a bight part which is fixedly and perpendicularly joined between the rearward ends of said elongate connecting elements, said last-mentioned bight part being positioned to overlie the upwardly and rearwardly oriented surface of said second leg members so that the latter are confined within the interior of the fourth U-shaped element, said holding structures comprising hooklike structures which are fixed to and project upwardly from said second leg members adjacent the rearward ends thereof for releasable engagement with said last-mentioned bight part; and said supporting member comprising a fifth U-shaped element having a bight part which is elongated and at opposite ends is joined to a pair of short leg parts which at their free ends are rigidly joined to respective first leg members, said short leg parts projecting generally upwardly from said first leg members when the chair is in said second configuration so that said last-mentioned bight part is spaced upwardly from said first leg members to supportingly engage said second leg members adjacent the forward ends thereof to maintain the forward ends of said second leg members in a slightly raised position relative to the rearward ends thereof.

6. A chair according to claim 5, including an elongated mat-like cushion of an elastomeric material having a first part mounted on said back support structure and a second part which overlies said seat part.

* * * * *